US007140822B2

(12) United States Patent
Hsieh

(10) Patent No.: US 7,140,822 B2
(45) Date of Patent: Nov. 28, 2006

(54) FASTENER FOR SECURING A CARGO CONTAINER

(76) Inventor: David Hsieh, 3f, No. 2, Chin-Chung St., Taichung City (TW)

( * ) Notice: Subject to any disclaimer, the term of this patent is extended or adjusted under 35 U.S.C. 154(b) by 0 days.

(21) Appl. No.: 11/245,344

(22) Filed: Oct. 6, 2005

(65) Prior Publication Data

US 2006/0093453 A1 May 4, 2006

(30) Foreign Application Priority Data

Oct. 29, 2004 (TW) ..... 93132953 A

(51) Int. Cl.
*B60P 7/08* (2006.01)

(52) U.S. Cl. ..... 410/85; 410/77; 410/96; 410/100

(58) Field of Classification Search ..... 410/85, 410/96, 97, 77, 80, 81, 100; 114/75; 248/499
See application file for complete search history.

(56) References Cited

U.S. PATENT DOCUMENTS

| | | | | |
|---|---|---|---|---|
| 4,249,840 | A * | 2/1981 | Kallaes et al. | 410/84 |
| 6,666,634 | B1 | 12/2003 | Hsieh | 410/85 |
| 6,669,417 | B1 * | 12/2003 | Hsieh | 410/85 |
| 6,758,643 | B1 * | 7/2004 | Hsieh | 410/85 |

* cited by examiner

*Primary Examiner*—Stephen Gordon
(74) *Attorney, Agent, or Firm*—Baker & Daniels

(57) ABSTRACT

A fastener for securing a cargo container includes a first fastener component, a second fastener component, and a lock assembly. The first fastener includes a pair of rods which bridge a first and a second fixed body. The lock assembly is disposed between and slidable along the pair of rods. A rotary member is disposed in the lock assembly and rotatable relative to the lock assembly within a limited angular distance, the rotary member having a non-circular locking hole. The second fastener component extends between the pair of rods through a screw hole formed in the first fixed body, and has a locking portion of non-circular cross section extending into and engaging the locking hole of the rotary member.

7 Claims, 6 Drawing Sheets

FASTENER FOR SECURING A CARGO CONTAINER

CROSS-REFERENCE TO RELATED APPLICATION

This application claims the priority of Taiwanese Invention Patent Application No. 93132953 filed Oct. 29, 2004.

BACKGROUND OF THE INVENTION

1. Field of the Invention

The present invention relates to a fastener, more particularly to a fastener for securing a container on the deck of a cargo vessel or ship in which the components of the fastener can be easily and smoothly assembled and ineffective fastening can be avoided.

2. Description of the Related Art

Generally, when containers are being transported in a cargo vessel or ship, in order to prevent undesired movement or toppling down of the containers 11 stacked on the ship as shown in FIG. 1, lashing ropes 2 and fastening assemblies 3 are used to secure the containers 11 to deck fittings (not shown) on a deck 12 of the ship. The conventional fastening assembly 3 includes a connecting member 31 and a connecting rod 32 that are connected in threaded engagement. However, when the ship pitches and rolls in a stormy sea, the threaded connection may be loosened thus resulting in disengagement of the connecting member 31 from the connecting rod 32 and, hence, ineffective fastening.

U.S. Pat. No. 6,666,634 proposes a "Positioning assembly for positioning a container on a platform," which was intended to overcome the aforesaid drawback of the conventional fastening assembly. The positioning assembly includes a limiting seat formed with a limiting hole, and a platform-connecting rod that engages threadedly a container-connecting unit and that has an engaging stud portion for engaging the limiting hole to arrest rotation of the platform-connecting rod, thereby preventing undesired disengagement of the platform-connecting rod from the container-connecting unit.

In the conventional fastener described above, however, it is found that the process of attaching the platform-connecting rod to the limiting seat with the engaging stud of the platform-connecting rod engaging the limiting hole of the limiting seat cannot be performed smoothly, particularly due to the non-circular cross sectional shape of both the engaging stud and the limiting hole. The present invention is directed to such drawback.

SUMMARY OF THE INVENTION

Therefore, a main object of the present invention is to provide an improvement over the conventional fasteners in terms of enhancing the smoothness of operation in the process of engagement of the locking components of such fasteners.

Accordingly, the present invention provides a fastener for fastening a cargo container which comprises a first and a second fastener component, a lock assembly and a rotary member. The first fastener component includes a first fixed body and a second fixed body, and a pair of rods bridging the first and second fixed bodies, the first fixed body having a screw hole. The lock assembly is disposed between and slidable along the rods of the first fastener component. The rotary member is disposed in the lock assembly and rotatable relative to the lock assembly within a limited angular distance, the rotary member having a non-circular locking hole. The second fastener component extends threadedly through the screw hole toward the second fixed body and has a locking portion of a non-circular cross section extending into and engaging the locking hole of the rotary member.

BRIEF DESCRIPTION OF THE DRAWINGS

Other features and advantages of the present invention will become apparent in the following detailed description of a preferred embodiment with reference to the accompanying drawings, in which.

DETAILED DESCRIPTION OF THE PREFERRED EMBODIMENT

Figure 1:
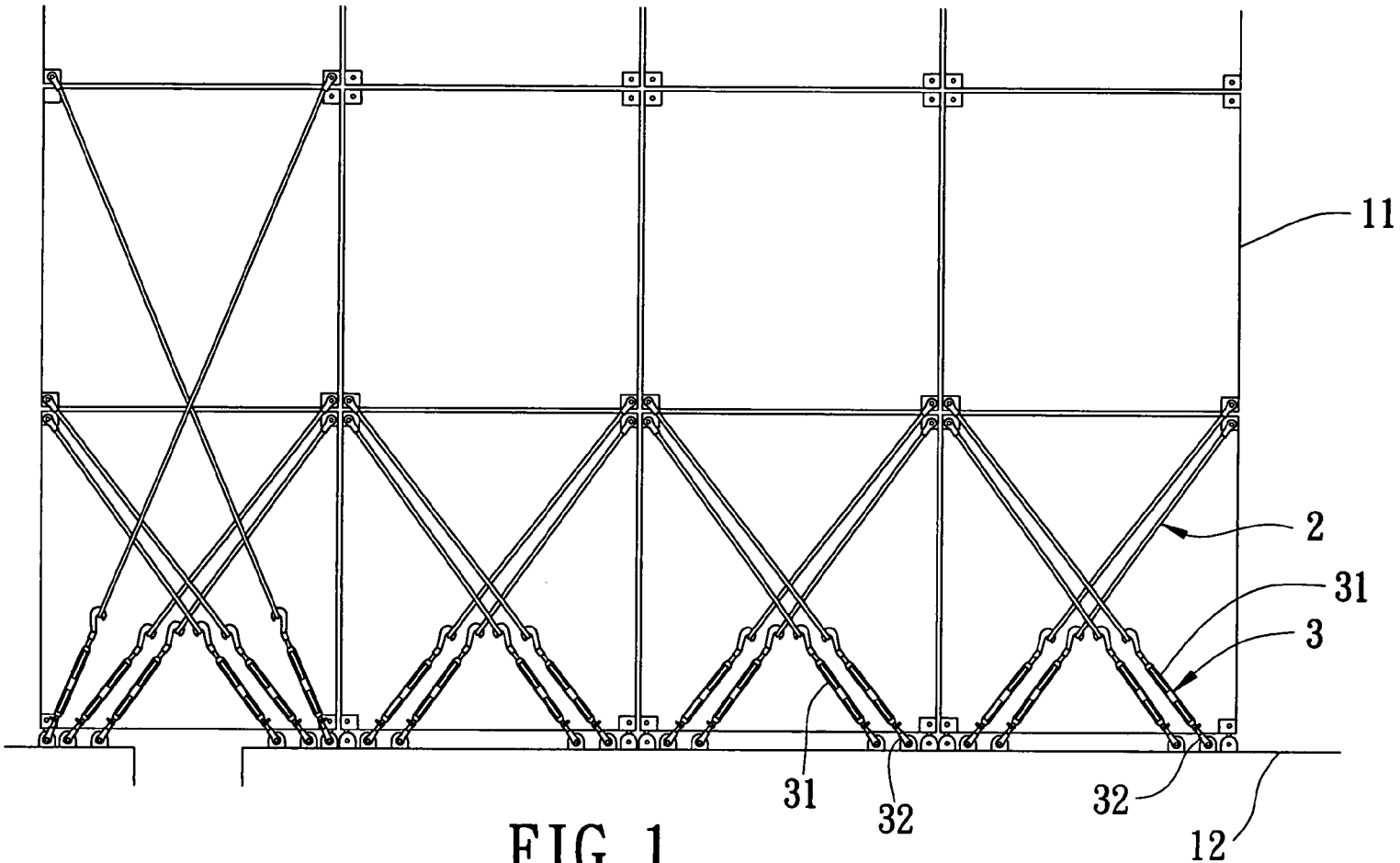
FIG. 1 PRIOR ART
FIG. 1 is a schematic view showing the conventional fastener assemblies securing a stack of containers on the deck of a ship.
Figure 2:
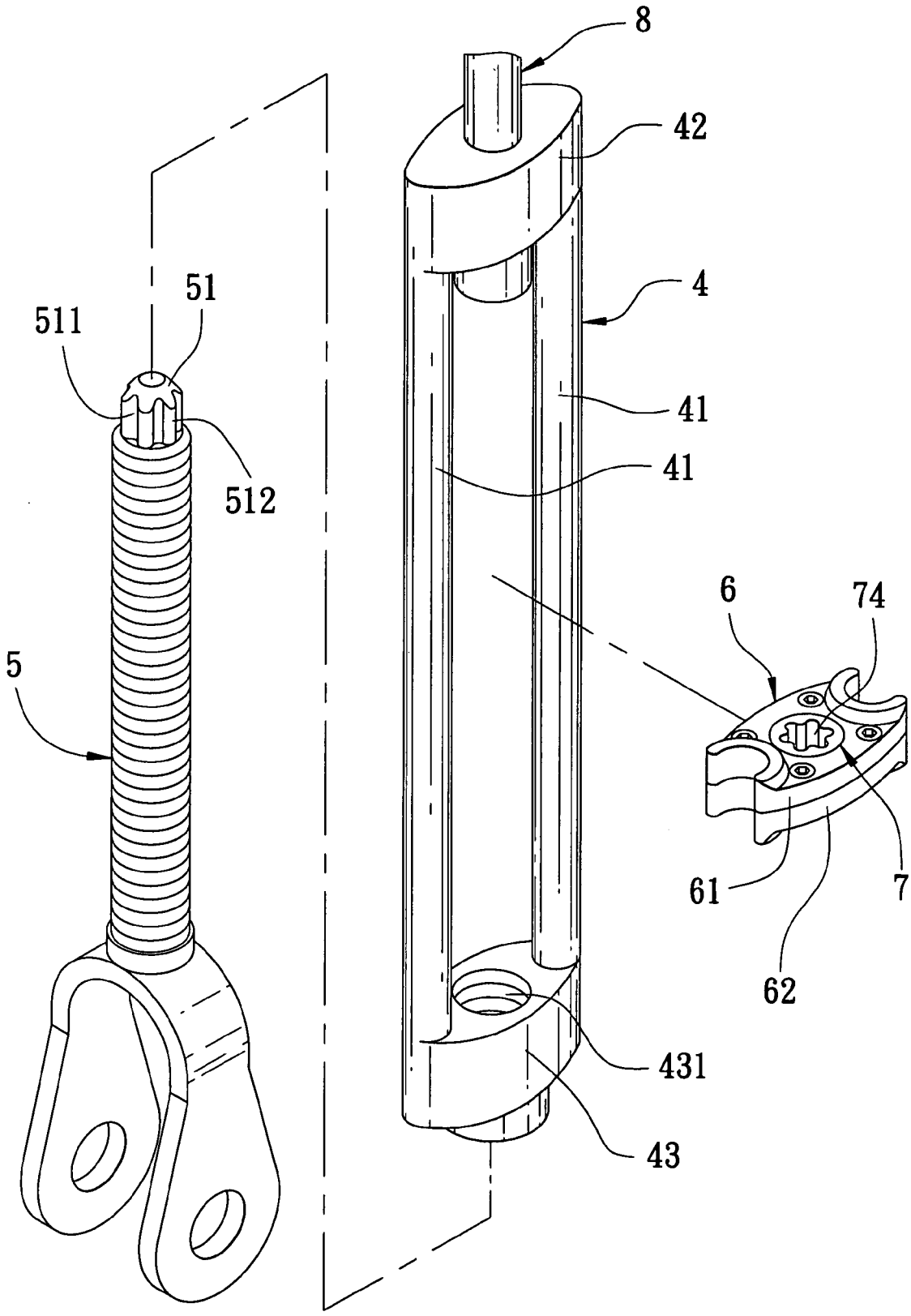
FIG. 2 is an exploded, perspective view of a preferred embodiment of the fastener according to the present invention.
Figure 3:
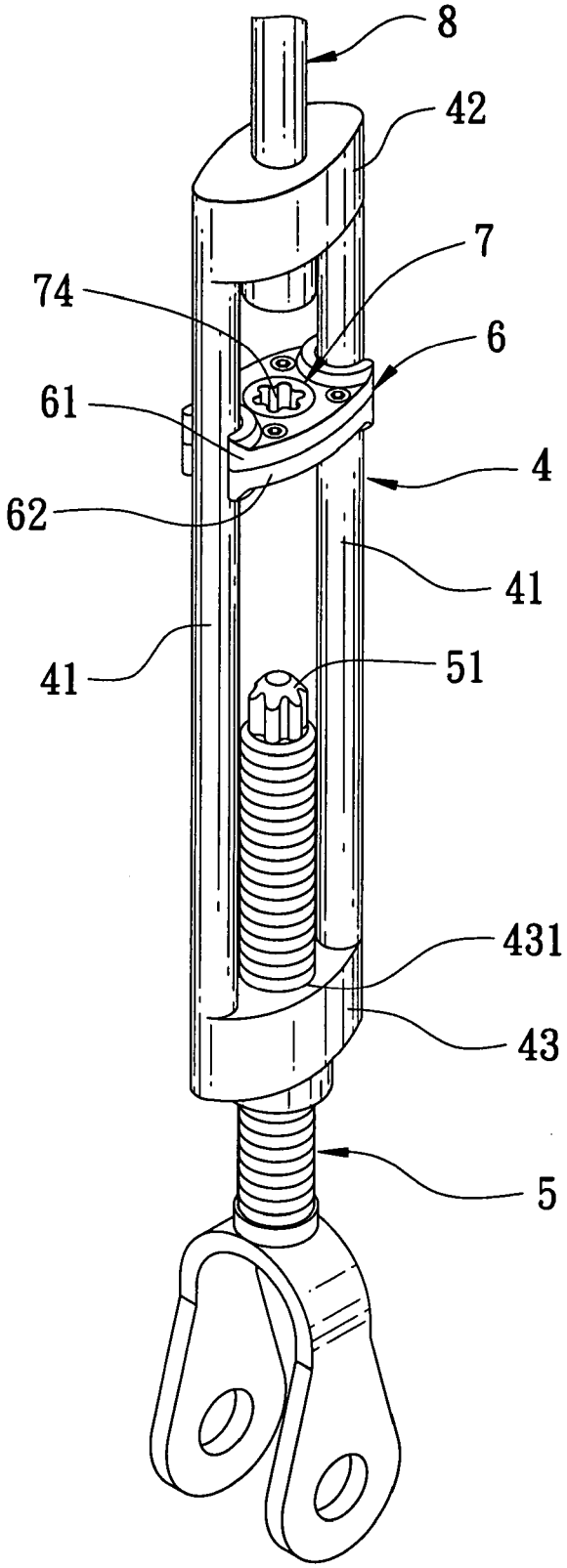
FIG. 3 is a perspective view of the preferred embodiment in an assembled state.

With reference to FIGS. 2 and 3, a fastener for a cargo container according to a preferred embodiment of the present invention generally comprises a first fastener component 4, a second fastener component 5, a lock assembly 6 and a rotary member 7.

The first fastener component 4 includes a pair of rods 41 bridging a first fixed body 43 and a second fixed body 42. A screw hole 431 is provided between the two opposing ends of the first fixed body 43.

The second fastener component 5 is externally threaded and extends through the screw hole 431 of the first fixed body 43. The second fastener component 5 has an upper end provided with a non-circular locking portion 51. In this embodiment, the locking portion 51 is toothed and has a plurality of radially projecting teeth 512 and a plurality of recesses 511.

Figure 4:
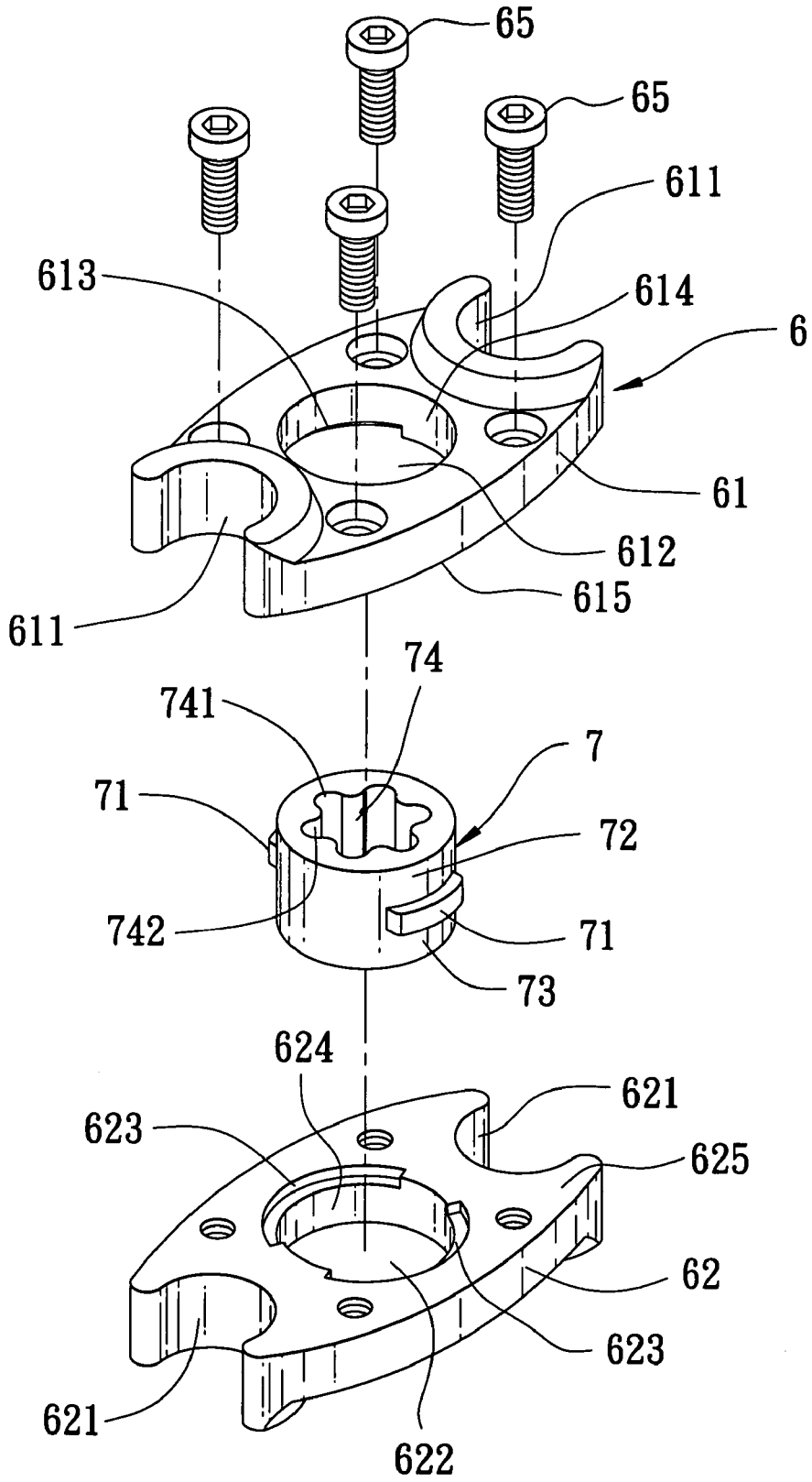
FIG. 4 is an exploded, perspective view showing detailed construction of the lock assembly and the rotary member of the fastener according to the preferred embodiment.

The lock assembly 6 is mounted on the rods 41 for sliding movement along the rods 41 so as to move away or toward the second fixed body 42 as shown in FIG. 3. With reference to FIG. 4, the lock assembly 6 in the preferred embodiment is configured as a two-piece body formed by a pair of stacked lock members 61,62 of symmetrical construction. That is, the lock members 61,62 each have two opposite ends 611,621 abutting respectively against the rods 41, a through-hole 612,622 formed between the opposite ends 611,621, and a pair of circumferential grooves 613,623. The through-holes 612,622 are defined by inner walls 614,624, respectively. The paired grooves 613 (only one is shown) are formed on the inner wall 614 substantially opposite to each other in a diametrical direction of the locking hole 612. Similarly, the paired grooves 623 are formed in an inner wall 624 in two diametrically opposite positions.

The lock members 61,62 may be joined together by means well known in the art, such as by bolts 65, such that the two opposite ends 611, through-hole 621 and pair of grooves 613 of one lock member 61 are aligned with the two opposite ends 621, through-hole 622 and pair of grooves 623 of the other lock member 62. The grooves 613 are connected to the respective grooves 623 adjacent the opposite inner faces 615,625 of the lock members 61,62 which face each other.

The rotary member 7 includes a non-circular locking hole 74 and a pair of circumferential projections 71 formed substantially opposite each other at an outer peripheral surface of the rotary member 7 thereby dividing the rotary member 7 into an upper portion 72 and a lower portion 73. In this embodiment, the locking hole 74 is toothed and has a plurality of radially projecting recesses 741 defining a plurality of teeth 742. Each projection 71 is slidably received in the interconnected two grooves 613,623, of the stacked lock members 61,62. The upper portion 72 and lower portion 73 of the rotary member 7 extend into the locking holes 612,622, respectively, of the lock members 61,62.

The rotary member 7 is rotatable relative to the lock assembly 6 within a limited angular distance as dictated by the dimension of the interconnected grooves 613,623 which cooperatively receive the projections 71 therein. The distance that each projection 71 displaces within the corresponding groove 613 or 623 is about one pitch of the teeth 742.

The fastener of the present invention is assembled as shown in FIG. 3. When the fastener of the present invention is used in conjunction with a lashing rope 8, to which the first fastener component 4 is connected, to secure a cargo container to a deck fitting (not shown in the drawings), the second fastener component 5 is threaded into the screw hole 431 to a certain depth and the lock assembly 6 mounted on the rods 41 is pressed lightly to slide downward along the rods 41, aided by its own weight, until the locking portion 51 of the second fastener component 5 is positioned and engaged in the locking hole 74 of the rotary member 7. The threaded depth of the second fastener component 5 in the screw hole 431 may be further adjusted to provide the desired tension of the rope 8.

Figure 6:
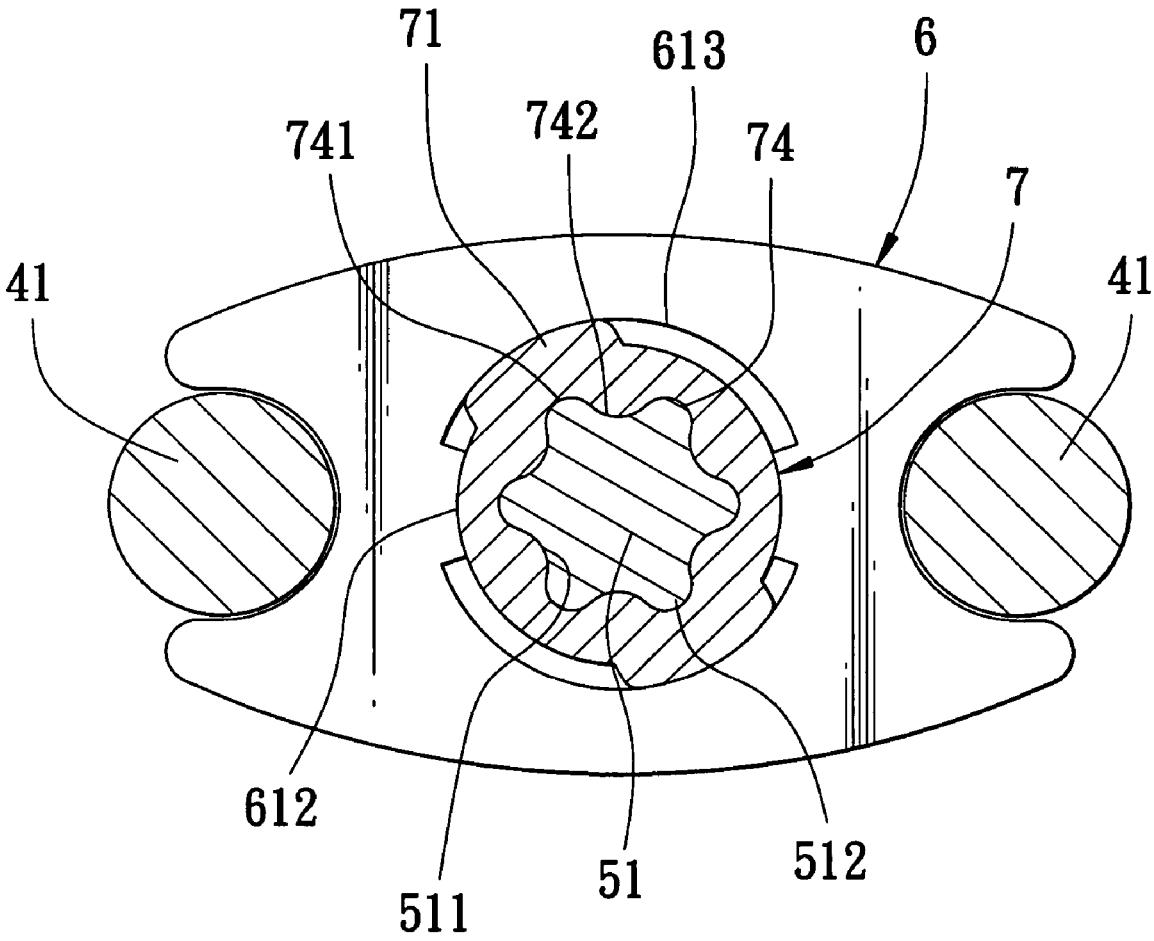
FIG. 6 is a sectional view similar to FIG. 5, but showing the teeth of the locking portion respectively aligned with and received into the radially projecting recesses of the locking hole.

In the process of fitting the locking portion 51 in the locking hole 74 described above, the lock assembly 6 is slid along the rods 41 until the locking hole 74 reaches the locking portion 51. At this point, if the radially projecting recesses 741 and teeth 742 of the locking hole 74 are exactly aligned with the radially projecting teeth 512 and recesses 511 of the locking portion 51, respectively, then the locking portion 51 can be fitted directly and smoothly into the locking hole 74, as shown in FIG. 6.

Figure 5:
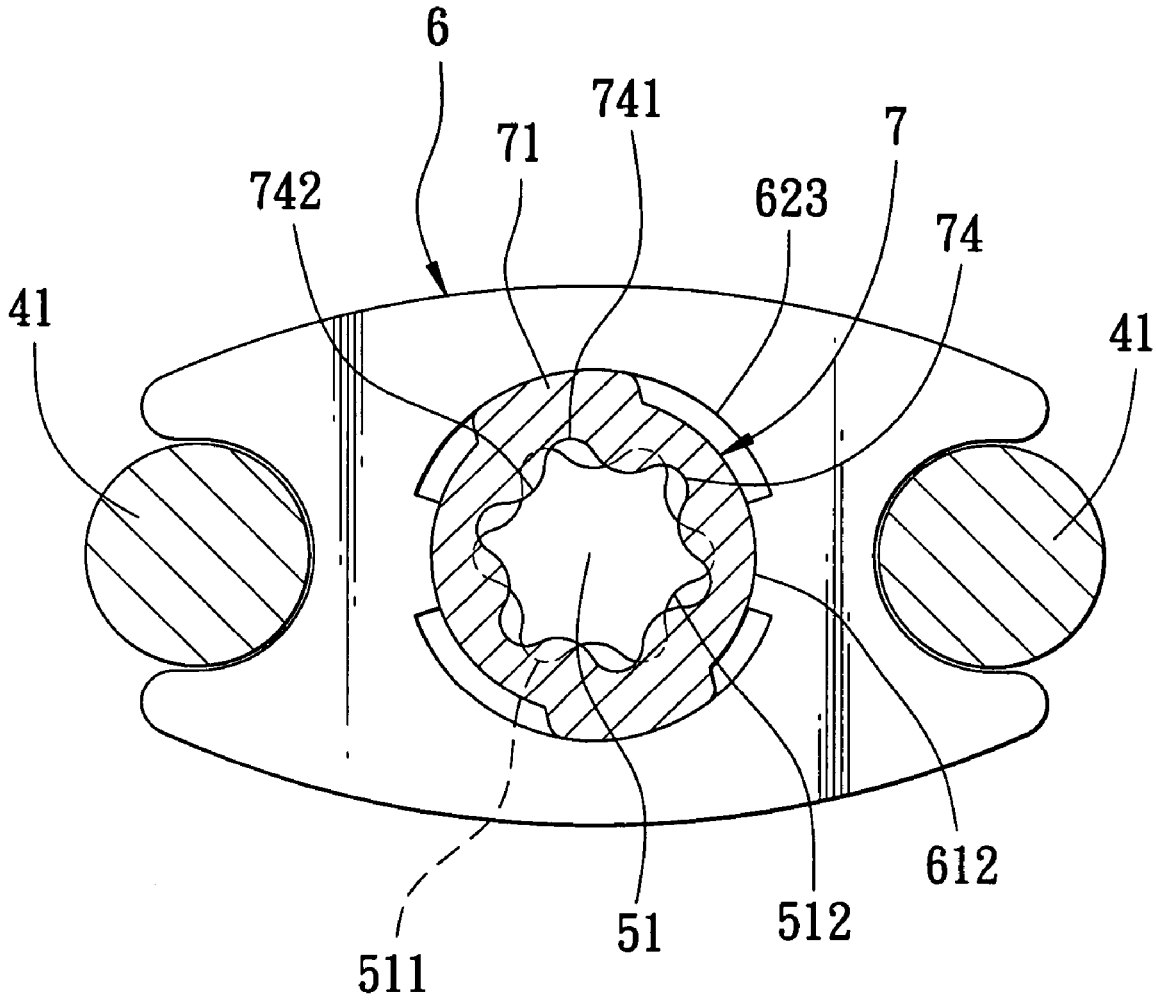
FIG. 5 is a sectional view of the preferred embodiment, showing the teeth of the locking portion unaligned with the radially projecting recesses of the locking hole in the process of inserting the locking portion into the locking hole.

On the other hand, if in the process of fitting the locking portion 51 into the locking hole 74, the recesses 741 and teeth 742 of the locking hole 74 are misaligned with the teeth 512 and recesses 511 of the locking portion 51 as shown in FIG. 5, since the teeth 512 of the locking portion 51 contact the respective teeth 742 of the locking hole 74, the pressing downward of the lock assembly 6 will urge the rotary member 7 to rotate to and fro within a limited distance until the teeth 512 and 742 are fitted into the recesses 741 and 511, respectively.

It is worthwhile to mention that, because the teeth 512 and 742 are generally rounded, when the teeth 742 are urged against the teeth 512, the smoothness of the rotation of the rotary member 7 is enhanced. Moreover, since the rotary member 7 can only rotate in a one-pitch distance, the occurrence of loosening of the first fastener component 4 from the second fastener component 5 can be prevented, thereby the container can be stably secured on the deck of the ship.

It can be appreciated, from the foregoing, that the process of fitting the locking portion 51 into the locking hole 74 can be performed smoothly and conveniently by virtue of the rotary member 7 being rotatable relative to the lock assembly 6 within a limited angular distance such that the locking hole 74 can adjust itself automatically to align the teeth 512 and 742 with the recesses 741 and 511, respectively, and receive the locking portion 5.

While the present invention has been described in connection with what is considered the most practical and preferred embodiment, it is understood that this invention is not limited to the disclosed embodiment. For instance, the lock assembly 6 may be configured as a one-piece body including a single lock member. Furthermore, while the described embodiment is configured to include a pair of grooves 613,623 on the lock members 61,62 and a corresponding pair of projections 71 on the rotary member 7, it should be apparent that providing only one of such grooves 613 or 623 and only one of such projections 71 would still achieve the intended objective of the present invention. Therefore, the true scope and spirit of the invention reside in the appended claims and their legal equivalents.

What is claimed is:

1. A fastener for securing a cargo container, comprising:

a first fastener component including a first fixed body and a second fixed body, and a pair of rods bridging said first and said second fixed body, said first fixed body having a screw hole;

a lock assembly disposed between and slidable along said rods;

a rotary member disposed in said lock assembly and rotatable relative to said lock assembly within a limited angular distance, said rotary member having a non-circular locking hole; and a second fastener component extending threadedly through said screw hole toward said second fixed body and having a locking portion of a non-circular cross section extending into and engaging said locking hole of said rotary member.

2. The fastener as claimed in claim 1, wherein said lock assembly includes a lock member having two opposite ends abutting respectively against said rods, and a through hole formed between said opposite ends, said rotary member being disposed in said through-hole in a limitedly rotatable position.

3. The fastener as claimed in claim 2, wherein said through-hole of said lock member is defined by an inner wall having a circumferential groove, and said rotary member has a circumferential projection received in said groove, said projection being slidable within said groove.

4. The fastener as claimed in claim 1, wherein said lock assembly includes a pair of stacked lock members each having two opposite ends and a through-hole formed between said opposite ends, said rotary member being disposed in said through-holes of said lock members in a limitedly rotatable position.

5. The fastener as claimed in claim 4, wherein said rotary member has a circumferential projection, and said lock members have opposite inner faces which face each other, each of said lock members further including an inner wall defining said respective through hole, and at least one circumferential groove formed in said respective inner wall adjacent said respective faces, said grooves of said lock members being interconnected adjacent said inner faces and cooperatively receiving said projection, said projection being slidable in said grooves.

6. The fastener as claimed in claim 5, wherein a pair of said circumferential grooves are formed in each said inner wall in two diametrically opposite positions.

7. The fastener as claimed in claim 3, wherein said locking portion is a toothed portion having a plurality of teeth and said locking hole has a plurality of radially projecting recesses for receiving said teeth.

* * * * *